US005716315A

United States Patent [19]

Turner

[11] Patent Number: 5,716,315

[45] Date of Patent: Feb. 10, 1998

[54] FLAG FOLDING AID

[76] Inventor: Richard L. Turner, 2002 Lindora Way, Midland, Tex. 79707

[21] Appl. No.: 511,783

[22] Filed: Aug. 7, 1995

[51] Int. Cl.[6] ..... B65H 45/04

[52] U.S. Cl. ..... 493/480; 269/45; 493/405

[58] Field of Search ..... 493/395, 405, 493/468, 475, 476, 480; 269/45, 46, 97, 98, 296

[56] References Cited

U.S. PATENT DOCUMENTS

| | | | |
|---|---|---|---|
| D. 256,216 | 8/1980 | Van Horn | 269/46 |
| 282,436 | 7/1883 | Bowser | 269/46 |
| 476,754 | 6/1892 | Mendelson | 269/45 |
| 3,689,059 | 9/1972 | Gross | 269/100 |
| 3,713,643 | 1/1973 | Gerstenberger | 493/405 |

*Primary Examiner*—Jack W. Lavinder

[57] ABSTRACT

A device for use in assisting a person in folding a flag. The device comprises a band having an internal diameter, a first end and a second end and an intermediate extent therebetween. The band is formed into a circular configuration with first and second ends in alignment. A plate is positioned upon the band opposite the first and second ends. A threaded aperture is formed within the plate. A clipping arm is included and has a first end and a second end and an intermediate extent therebetween. A hole is formed within the first end of the arm. A clip is positioned upon the second end of the arm. A hook arm has a first end and a second end and an intermediate extent therebetween. A hole is formed within the first end of the arm. A hook is positioned upon the second end of the arm. A screw is positioned through the hole within the first end of the clipping arm and within the hole within the first end of the hook arm. The screw is threadably secured within the aperture of the plate. The screw functions to rotatably couple the hook arm and the clipping arm to the band.

5 Claims, 4 Drawing Sheets

FLAG FOLDING AID

BACKGROUND OF THE INVENTION

1. Field of the Invention

The present invention relates to flag folder and more particularly pertains to a device for and method of folding a flag.

2. Description of the Prior Art

The use of aids for folding sheets is known in the prior art. More specifically, these aids heretofore devised and utilized for the purpose of folding are known to consist basically of familiar, expected, and obvious structural configurations, notwithstanding the myriad of designs encompassed by the crowded prior art which has been developed for the fulfillment of countless objectives and requirements.

For example, U.S. Pat. 3,961,782 to Lowry discloses a aid for folding sheets and the like. U.S. Design Pat. No. 244,014 to Kim discloses a universal adjustable flagpole. U.S. Pat. 3,749,038 to Dodsworth discloses a material folding and stitching aid. U.S. Pat. No. 3,713,643 to Gerstenberger discloses a folding aid. U.S. Pat. No. 5,255,627 to Williams discloses a flag and flagpole attachment.

In this respect, the flag folder according to the present invention substantially departs from the conventional concepts and designs of the prior art, and in doing so provides an apparatus primarily developed for the purpose of folding flags.

Therefore, it can be appreciated that there exists a continuing need for new and improved flag folder which can be used for folding flags. In this regard, the present invention substantially fulfills this need.

SUMMARY OF THE INVENTION

In view of the foregoing disadvantages inherent in the known types of folding aids now present in the prior art, the present invention provides an improved flag folder. As such, the general purpose of the present invention, which will be described subsequently in greater detail, is to provide a new and improved flag folder and method which has all the advantages of the prior art and none of the disadvantages.

To attain this, the present invention essentially comprises a method of folding a flag. The flag is standard having a first end with two apertures and a second end. The method utilizing a device secured to a flagpole. The method including the following steps. Providing a band, the band having an internal diameter, a first end and a second end and an intermediate extent therebetween, a hole formed within the first end, a hole formed within the second end, the band being formed into a circular configuration with first and second holes being in alignment. Securing a screw within the hole of the first end and within the hole of the second end. Positioning a nut over the screw, a plate, with a threaded aperture formed therein, positioned upon the band opposite the screw, the screw and nut functioning to adjust the internal diameter of the band. Securing the band about a flagpole. Providing a clipping arm, the clipping arm having a first end and a second end and an intermediate extent therebetween, a hole formed within the first end of the arm, a clip positioned upon the second end of the arm. Providing a hook arm, the hook arm having a first end and a second end and an intermediate extent therebetween, a hole formed within the first end of the arm, a hook positioned upon the second end of the arm. Providing a screw, the screw positioned through the hole within the first end of the clipping arm and within the hole within the first end of the hook arm, the screw threadably secured within the hole of the plate, the screw functioning to rotatably couple the hook arm and the clipping arm to the band. Folding the flag in half such that the two apertures of the first end come into alignment. Securing the two aligned apertures over the hook of the hook arm and securing the folded corner of the first end within the clip of the clipping arm. Folding the flag into triangular sections from the second towards the first end, removing the first end from hook and from the clip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved flag folder which have all the advantages of the prior art folders and none of the disadvantages.

It is another object of the present invention to provide new and improved flag folder which may be easily and efficiently manufactured and marketed.

It is further object of the present invention to provide new and improved flag folder which are of durable and reliable constructions.

An even further object of the present invention is to provide new and improved flag folder which are susceptible of a low cost of manufacture with regard to both materials and labor, and which accordingly are then susceptible of low prices of sale to the consuming public, thereby making such flag folder economically available to the buying public.

Still yet another object of the present invention is to provide new and improved flag folder which provide in the apparatuses and methods of the prior art some of the advantages thereof, while simultaneously overcoming some of the disadvantages normally associated therewith.

Even still another object of the present invention is to provide a method of folding flags.

Lastly, it is an object of the present invention to provide new and improved device for use in assisting a person in folding a flag, the device includes the following components. A band having an internal diameter, a first end and a second end and an intermediate extent therebetween. A hole formed within the first end, a hole formed within the second end. The band being formed into a circular configuration with first and second holes being in alignment. A screw secured within the hole of the first end and within the hole of the second end. A nut positioned over the screw, a plate positioned upon the band opposite the screw, the screw and nut functioning to adjust the internal diameter of the band. A threaded aperture formed within the plate. A clipping arm having a first end and a second end and an intermediate extent therebetween. A hole formed within the first end of the arm, a clip positioned upon the second end of the arm, means positioned intermediate the first and second ends for use in adjusting the length of the clipping arm. A hook arm having a first end and a second end and an intermediate extent therebetween, a hole formed within the first end of the arm, a hook positioned upon the second end of the arm, means positioned intermediate the first and second ends for use in adjusting the length of the hook arm. A screw positioned through the hole within the first end of the clipping arm and within the hole within the first end of the hook arm, the screw threadably secured within the aperture of the plate, the screw functioning to rotatably couple the hook arm and the clipping arm to the band.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
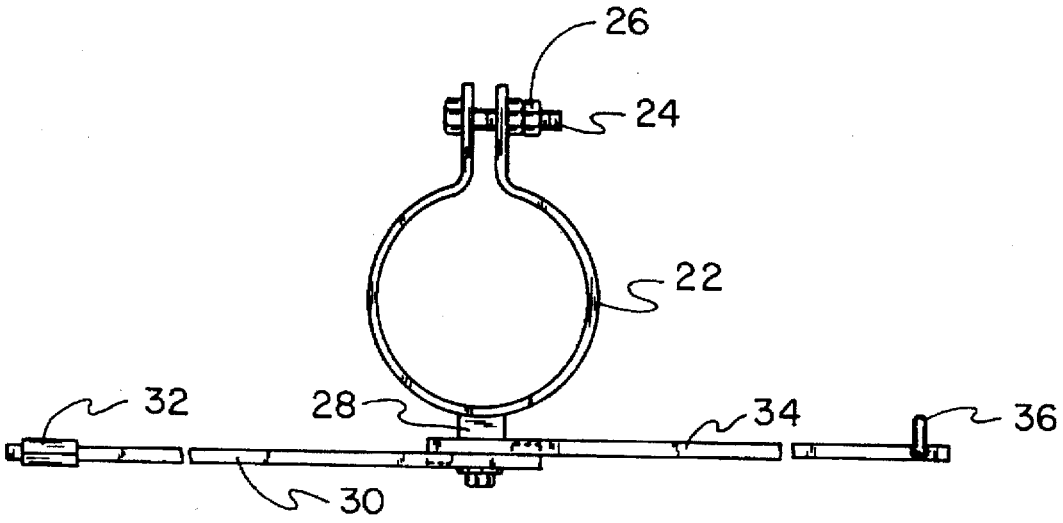
FIG. 1 is a plan view of the preferred embodiment of the flag folder constructed in accordance with the principles of the present invention.
Figure 2:
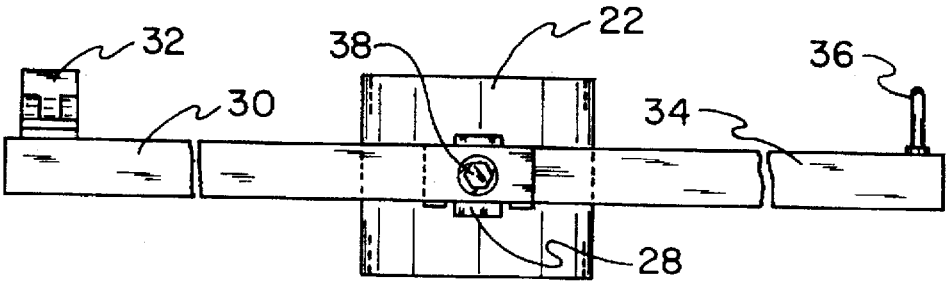
FIG. 2 is a side elevational view of the flag folder.
Figure 3:
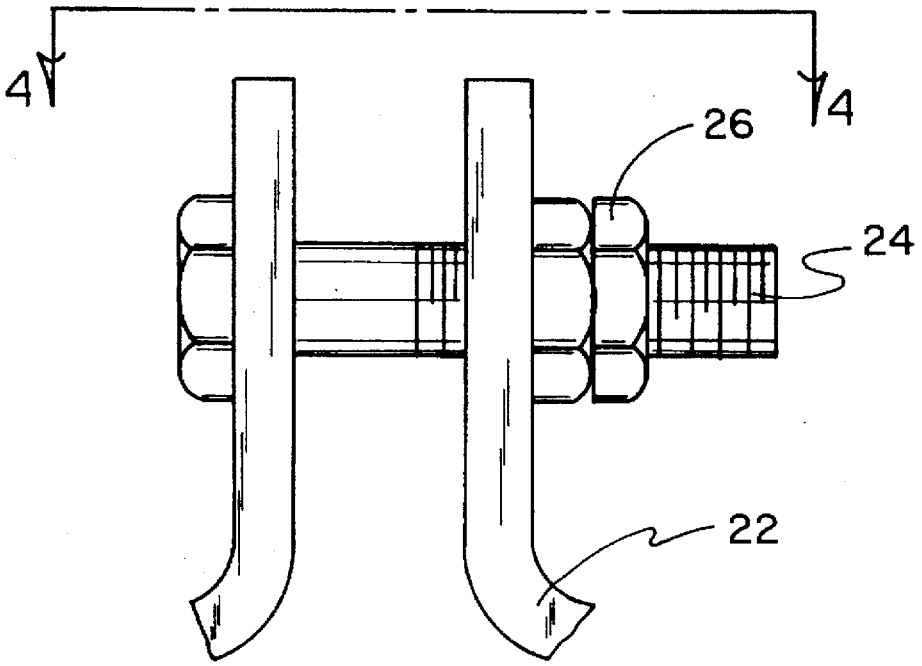
FIG. 3 is a view of the band with nut and screw.
Figure 4:
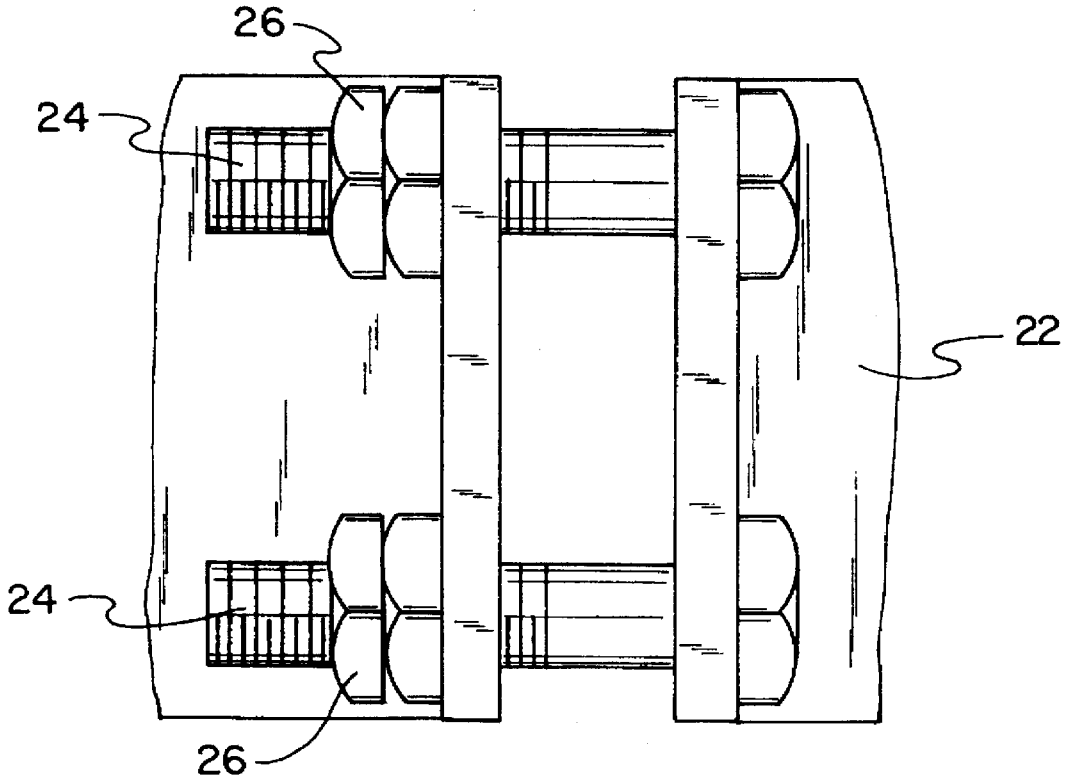
FIG. 4 is a view taken along line 4—4 of FIG. 3.
Figure 5:
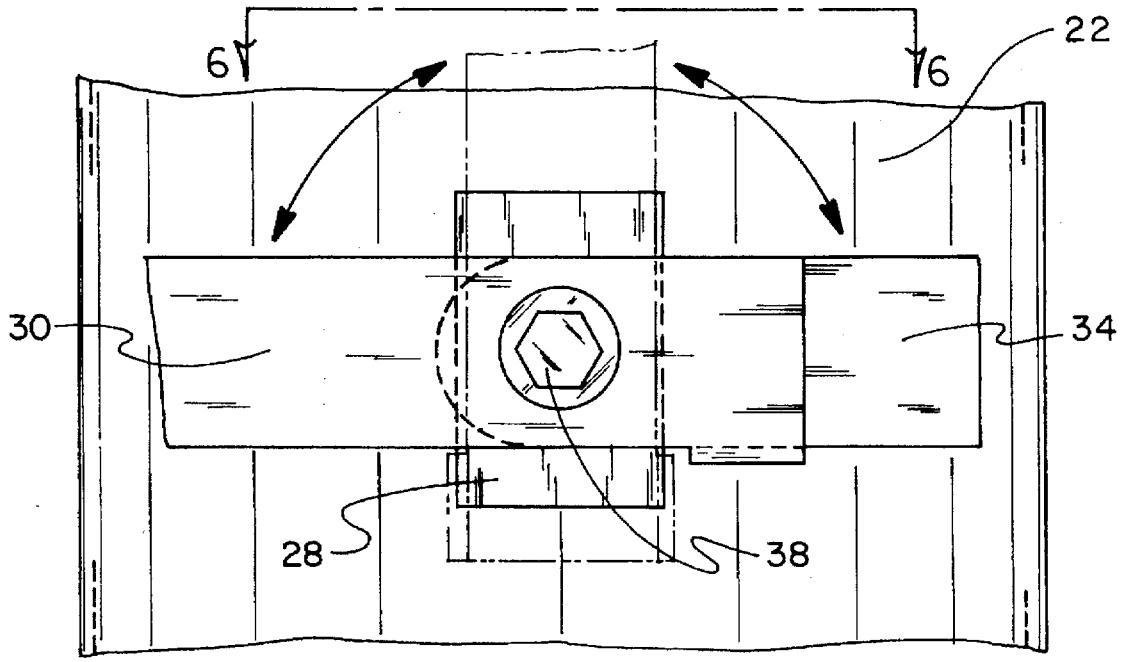
FIG. 5 is view of the screw coupling the arms to the band.
Figure 6:
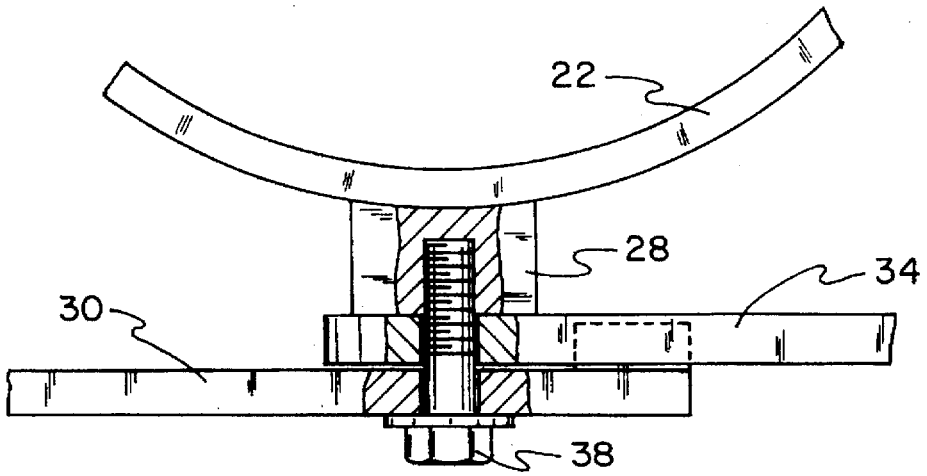
FIG. 6 is a view taken along line 6—6 of FIG. 5.
Figure 7:
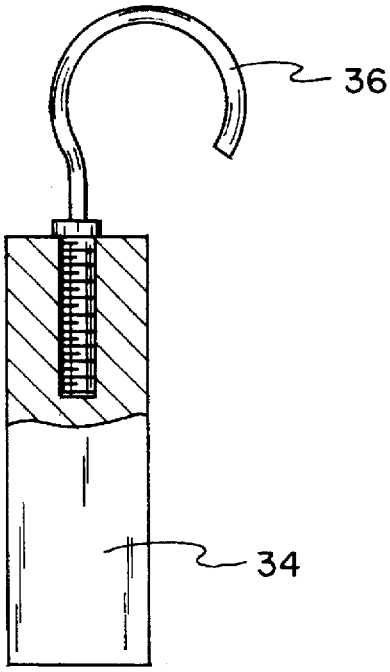
FIG. 7 is a view of the hook of the present invention.
Figure 8:
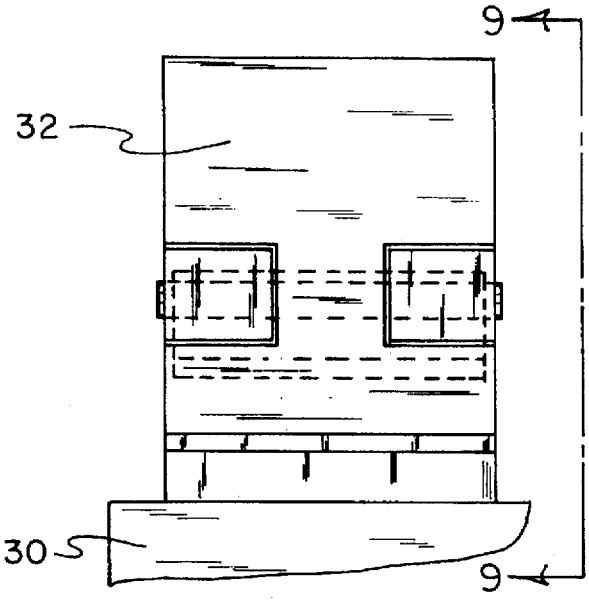
FIG. 8 is a view of the clip in accordance with the present invention.
Figure 9:
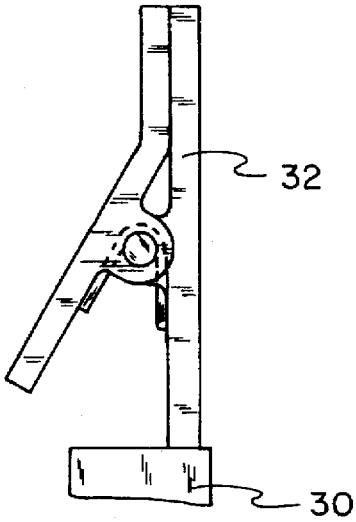
FIG. 9 is a view taken along lines 9—9 of FIG. 8.

With reference now to the drawings, and in particular to FIG. 1 thereof, the preferred embodiment of the new and improved flag folder embodying the principles and concepts of the present invention and generally designated by the reference numeral 10 will be described.

The present invention relates to a device for use in folding a flag and a method of using the device. In its broadest context, the present invention includes a device which is adapted to be secured about a flagpole. The device includes a band which is secured about the flag pole and two arms which are pivotally secured to the band. One of the arms has a hook at its outermost extremity and the other arm has a clip at its outermost extremity. The method involves the steps of employing the device for folding a flag. First, the specifics involving the device will be described, then the method.

The band 22 has an internal diameter, a first end, a second end and an intermediate extent therebetween. Holes are formed within the first and second ends of the band 22. In order for the band 22 to fit about a flagpole, it is formed into a circular configuration with first and second holes being in alignment. A screw 24 is secured within the hole of the first end and within the hole of the second end and a nut 26 is positioned over the screw 24. The nut 26 and bolt are used in keeping the ends of the band 22 together. In order to provide sufficient strength two screws 24 can be employed in conjunction with two nuts 26. Together the screw 24 and nut 26 function to adjust the internal diameter of the band 22. Furthermore, a plate 28, with a centrally located threaded aperture, is positioned upon the band 22 opposite the screw 24.

Two arms are pivotally secured to the band 22. The first arm, or the clipping arm 30 has a first end, a second end and an intermediate extent therebetween. A hole is formed within the first end of the arm and a clip 32 is positioned upon the second end of the arm. Means are positioned intermediate the first and second ends for use in adjusting the length of the clipping arm 30. This means, in the preferred embodiment takes the form of a telescopic arrangement. The second arm, or the hook arm 34, has a first end and a second end and an intermediate extent therebetween. A hole is formed within the first end of the arm and a hook 36 is positioned upon the second end of the arm. Like the first arm, means are positioned intermediate the first and second ends for use in adjusting the length of the hook arm 34 and this means can take the form of a telescopic arrangement.

A screw 38 is positioned through the hole within the first end of the clipping arm 30 and within the hole within the first end of the hook arm 34. Additionally, this screw 38 is threadably secured within the aperture of the plate 28. This screw 38 functions to rotatably couple the hook arm 34 and the clipping arm 30 to the band 22. Thus, each of the arms can be selectively positioned anywhere about the aperture of the plate 28.

The method of using the above described device will now be described. The first step in the method involves securing the band 22 of the device around a flagpole. The screws 24 of the band 22 are employed in this step for ensuring that the band 22 fits securely about the periphery of the flagpole. The user then lowers the clipping arm 30 and the hook arm 34 to a horizontal orientation. When the arms are not in use they are stored in line with the length of the flagpole. The person employing the device then folds the flag in half such that the eyelets or holes of the first end are aligned with one another. In this orientation, the original length of the flag remains the same, but the width is divided in half. Now the aligned holes of the flag are secured to the hook 36 of the hook arm 34, and the fold of the first end of the flag is secured to the clip 32 of the clipping arm 30. Now the flag may be folded. This folding, if done in the traditional sense, is accomplished by folding the flag into triangular sections. When the folding is complete, the first end is removed from the hook 36 and the clip 32. The arms of the device may now be secured to their orientation in line with the length of the flagpole.

Thus, what has been described is a flagpole attachment that enables a single person to properly fold a flag—a job normally done by two people. The unit has an adjustable metal band that fits securely around any size flagpole. Two plastic, aluminum, or steel arms are attached to a plate on the band. When not in use, they pivot to a vertical position and align with the flagpole. When used for folding, they swing to a horizontal orientation and telescope outward to accommodate various sized flags. One end of the arm has a spring clip, while the other has either a hook or another spring clip. To prepare for use, the unit is pivoted to a horizontal position and the arms are extended. After the flag is lowered,it is folded twice without using the attachment. The result is a flag having the same length, but a width one fourth it original. One end of the partially folded flag is attached to the device using clips, while the other is held manually. The person then folds it into triangles and removes it upon reaching the pole. The arms are retracted and the entire mechanism is either removed from the pole or stored in a vertical orientation. Schools, companies, government agencies, or anyone else who flies a flag could save time and money by assigning one person to fold it each day, rather than two. The device is durable and could be stored directly on the flagpole, conserving space.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for use in assisting a person in folding a flag, the device comprising in combination:

a band having an internal diameter, a first end and a second end and an intermediate extent therebetween, a hole formed within the first end, a hole formed within the second end, the band being formed into a circular configuration with first and second holes being in alignment, a screw secured within the hole of the first end and within the hole of the second end, a nut positioned over the screw, a plate positioned upon the band opposite the screw, the screw and nut functioning to adjust the internal diameter of the band, a threaded aperture formed within the plate;

a clipping arm having a first end and a second end and an intermediate extent therebetween, a hole formed within the first end of the arm, a clip positioned upon the second end of the arm, means positioned intermediate the first and second ends for use in adjusting the length of the clipping arm;

a hook arm having a first end and a second end and an intermediate extent therebetween, a hole formed within the first end of the arm, a hook positioned upon the second end of the arm, means positioned intermediate the first and second ends for use in adjusting the length of the hook arm;

a screw positioned through the hole within the first end of the clipping arm and within the hole within the first end of the hook arm, the screw threadably secured within the aperture of the plate, the screw functioning to rotatably couple the hook arm and the clipping arm to the band.

2. A device for use in assisting a person in folding a flag, the device comprising:

a band having an internal diameter, a first end and a second end and an intermediate extent therebetween, the band being formed into a circular configuration with first and second ends being in alignment, a plate positioned upon the band opposite the first and second ends, a threaded aperture formed within the plate;

a clipping arm having a first end and a second end and an intermediate extent therebetween, a hole formed within the first end of the arm, a clip positioned upon the second end of the arm;

a hook arm having a first end and a second end and an intermediate extent therebetween, a hole formed within the first end of the arm, a hook positioned upon the second end of the arm; and a screw positioned through the hole within the first end of the clipping arm and within the hole within the first end of the hook arm, the screw threadably secured within the aperture of the plate, the screw functioning to rotatably couple the hook arm and the clipping arm to the band.

3. The apparatus as set forth in claim 2 and further including means positioned intermediate the first and second ends of the arm for use in adjusting the length of the clipping arm.

4. The apparatus as set forth in claim 2 and further including means positioned intermediate the first and second ends for use in adjusting the length of the hook arm.

5. A method of folding a flag having a first end with two apertures and a second end, the method utilizing a device secured to a flagpole, the method comprising in combination:

providing a band, the band having an internal diameter, a first end and a second end and an intermediate extent therebetween, the first and second ends positioned adjacent one another such that the band is in a circular configuration, a plate positioned upon the band opposite the first and second ends, the plate having a threaded aperture formed therein;

securing the band about a flagpole;

providing a clipping arm, the clipping arm having a first end and a second end and an intermediate extent therebetween, a hole formed within the first end of the arm, a clip positioned upon the second end of the arm;

providing a hook arm, the hook arm having a first end and a second end and an intermediate extent therebetween, a hole formed within the first end of the arm, a hook positioned upon the second end of the arm;

providing a screw, the screw positioned through the hole within the first end of the clipping arm and within the hole within the first end of the hook arm, the screw threadably secured within the aperture of the plate, the screw functioning to rotatably couple the hook arm and the clipping arm to the band;

folding the flag in half such that the two apertures of the first end come into alignment;

securing the two aligned apertures over the hook of the hook arm, securing the folded corner of the first end within the clip of the clipping arm;

folding the flag into triangular sections from the second towards the first end, removing the first end from hook and from the clip.

* * * * *